US011670196B2

(12) United States Patent
Jubro

(10) Patent No.: US 11,670,196 B2
(45) Date of Patent: Jun. 6, 2023

(54) SUPPORT ARRANGEMENT FOR A UNIT USED WITHIN A RETAIL ENVIRONMENT

(71) Applicant: Pricer AB, Stockholm (SE)

(72) Inventor: Jörgen Jubro, Stockholm (SE)

(73) Assignee: PRICER AB, Stockholm (SE)

( * ) Notice: Subject to any disclaimer, the term of this patent is extended or adjusted under 35 U.S.C. 154(b) by 0 days.

(21) Appl. No.: 17/779,433

(22) PCT Filed: Nov. 24, 2020

(86) PCT No.: PCT/EP2020/083258
§ 371 (c)(1),
(2) Date: May 24, 2022

(87) PCT Pub. No.: WO2021/105149
PCT Pub. Date: Jun. 3, 2021

(65) Prior Publication Data

US 2022/0398945 A1 Dec. 15, 2022

(30) Foreign Application Priority Data

Nov. 25, 2019 (SE) ..... 1951338-1

(51) Int. Cl.
*G09F 3/20* (2006.01)
*G09F 7/06* (2006.01)

(52) U.S. Cl.
CPC ..... *G09F 3/204* (2013.01); *G09F 7/06* (2013.01)

(58) Field of Classification Search
CPC . G09F 3/204; G09F 7/06; G09F 3/208; A47G 1/1606
See application file for complete search history.

(56) References Cited

U.S. PATENT DOCUMENTS 3,899,841 A * 8/1975 Berger ..... G09F 3/08 40/658
2012/0023797 A1* 2/2012 Rosander ..... G09F 3/204 40/655

(Continued)

FOREIGN PATENT DOCUMENTS

EP 2230655 A1 9/2010
WO 2010107366 A1 9/2010
WO 2016111615 A1 7/2016

OTHER PUBLICATIONS

International Search Report corresponding in application PCT/EP2020/083258 dated Feb. 25, 2021, 4 pages.

(Continued)

*Primary Examiner* — Gary C Hoge
(74) *Attorney, Agent, or Firm* — Cooper Legal Group, LLC; Ronald M. Kachmarik

(57) ABSTRACT

A support arrangement within a retail environment. The arrangement includes a unit that includes a casing with a flat rear side, at least three recesses arranged in a pattern are formed in the rear side. The recesses are shaped such that a shoulder extends around at least a section of the recess in the rear side. The arrangement includes a support device including a flat support body to be secured to a wall and a shelf or a support structure. The support device includes a corresponding number of attachment protrusions that have shape and dimension corresponding to the recesses and each including a support surface to bear against the shoulder of the recesses to maintain the unit attached. The arrangement includes a releasable locking device arranged to maintain the support surfaces in contact with the shoulders in the recesses. The locking device has a male/female configuration.

9 Claims, 8 Drawing Sheets

(56) References Cited

U.S. PATENT DOCUMENTS

| | | | | |
|---|---|---|---|---|
| 2012/0060399 | A1* | 3/2012 | Sjodln | G09F 3/204 40/655 |
| 2014/0115935 | A1* | 5/2014 | Mason | A47G 1/1606 40/781 |
| 2015/0056009 | A1 | 2/2015 | Morris et al. | |
| 2022/0121238 | A1* | 4/2022 | Lin | G09F 15/0018 |

OTHER PUBLICATIONS

International Preliminary Report on Patentability from corresponding International application PCT/EP2020/083258 dated May 17, 2022, 6 pages.

* cited by examiner

SUPPORT ARRANGEMENT FOR A UNIT USED WITHIN A RETAIL ENVIRONMENT

FIELD OF THE INVENTION

The present invention relates to a support arrangement for a unit used within a retail environment.

BACKGROUND OF THE INVENTION

In stores, for example supermarkets etc, electronic shelf labels, also referred to as ESLs, are used for displaying information about the different products offered in the store. The information displayed could be the name and type of product, information regarding the product as well as the price for each of the products. Furthermore, cameras are more frequently used for example to monitor the amount of the goods remaining on the shelves and to ensure that the different products are in the intended order on the shelves.

The electronic shelf labels and/or cameras are communicating with a central control unit that makes it possible to frequently update, and change the information displayed on the labels which saves a considerable amount of time for the persons working in the store, especially if the number of different products sold in the store is high. As an example, a supermarket offers between 5000 and 20000 different products.

The most common type of electronic shelf labels are small and arranged side by side along the forward edge of shelves or desks adjacent to the product each ESL is intended to market but there is an increasing demand for larger displays in order to increase the size of the text and/or the amount of information that could be displayed, and cameras comprising the required components are often larger than conventional electronic shelf labels. The larger units, i.e. electronic shelf labels and cameras, however requires new flexible support arrangements and there is consequently a need for an improved support arrangement for larger units, i.e. electronic shelf labels and cameras.

SUMMARY OF THE INVENTION

The present invention, defined in the appended claims, provides a support arrangement for a unit used within a retail environment that to at least some extent fulfils the needs defined above.

The claimed support arrangement for a unit used within a retail environment comprises:

a unit comprising a casing with a substantially flat rear side, at least three recesses arranged in a predetermined pattern are formed in the rear side of the electronic shelf label, said recesses are shaped such that a shoulder extending around at least a section of the opening of the recess in the rear side;

a support device comprising a substantially flat support body intended to be secured to a wall, a shelf or a support structure, said support device comprises a corresponding number of attachment protrusions as the number of recesses, said attachment protrusions have shape and dimension corresponding to the recesses and each comprising a support surface intended to bear against the shoulder of the recesses to maintain the unit attached to the support device; and a releasable locking device arranged to maintain the support surfaces in contact with the shoulders in the recesses, said locking device has a male/female configuration.

The claimed support arrangement fulfils the needs defined above by providing a new type of support that in combination with the design of the unit ensures a reliable securing of the unit still making it easy to remove the unit when needed. Furthermore, the support arrangement is arranged behind the unit and give the unit the desired appearance with the support arrangement hidden behind. The position behind the unit is also favourable since the release of the unit requires knowledge about the arrangement which prevents unintentional removal by un-authorized persons.

In one embodiment of the support arrangement, the at least three recesses and corresponding attachment protrusions are arranged in a pattern that makes it possible to secure the unit to the support device in both a first and a second position, said first and second position are located 90° from each other. This embodiment is favorable since many units have a rectangular display, or field of view, and this embodiment of the arrangement makes it possible to attach the unit either in a position where the display or field of view extends horizontally or vertically. Furthermore, this embodiment provides a reliable and stable support since the attachment protrusions and recesses could be arranged in a two-dimensional pattern.

In one embodiment of the support arrangement, the support body has a rectangular or circular shape with smaller extension than the electronic shelf label in the plane of the rear side. This embodiment of the support body ensures that the support device is hidden behind the unit.

In one embodiment of the support arrangement, the number of recesses and attachment protrusions are at least four and arranged in the pattern of a square. This embodiment provides a flexible and stable support for the unit since the attachment protrusions and recesses are spread over a larger area In one embodiment of the support arrangement, the releasable locking device comprises a male element, a female element and a release element arranged to release the connection between the male and female element to release the electronic shelf label from the support device. The male/female configuration provides the desired reliable securing of the unit to the support device and the release element makes it possible to the release the unit when desired.

In one embodiment of the support arrangement, the male element and female element are arranged between the rear side of the unit and the flat support body, and the release element comprises an actuator extending substantially parallel to the flat support body outside the support body in the plane of the support body. In this embodiment of the arrangement, the different parts of the arrangement are protected between the support device and the unit.

In one embodiment of the support arrangement, the female element of the coupling device is a recess formed in the rear side of the electronic shelf label and the male part is a resilient protrusion arranged in the support body.

In one embodiment of the support arrangement, the release element is movable between a first position in which the electronic shelf label is attached to the support device and a second position in which the electronic shelf label is released from the support device.

In one embodiment of the support arrangement, the release element in the second position is arranged to force the resilient male element into a non-engagement position with the female element.

In one embodiment of the support arrangement, the release element is resiliently arranged in the support device such that it is returned to the first position if force is acting on the release element.

In one embodiment of the support arrangement, the unit is an electronic shelf label or a camera.

The different described embodiments of the invention could of course be combined in different ways without departing from the scope of the invention that will be described more in detail in the detailed description.

BRIEF DESCRIPTION OF THE DRAWINGS

One embodiment of the support arrangement according to the invention is illustrated in the appended figures.

DETAILED DESCRIPTION OF EMBODIMENTS

Figure 1A:
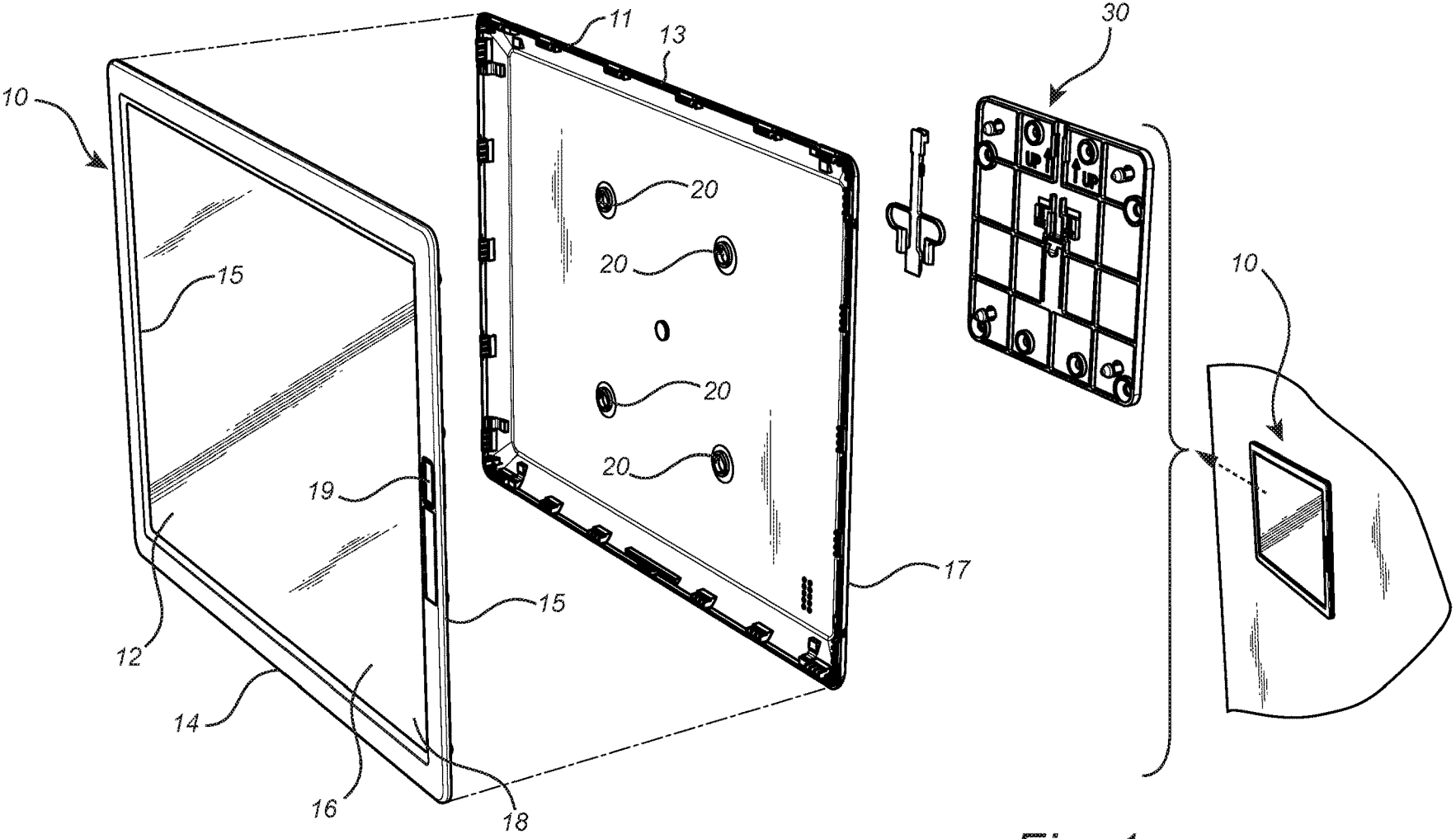
FIG. 1*a* illustrates an exploded perspective view of the different elements of the support arrangement.
Figure 1B:
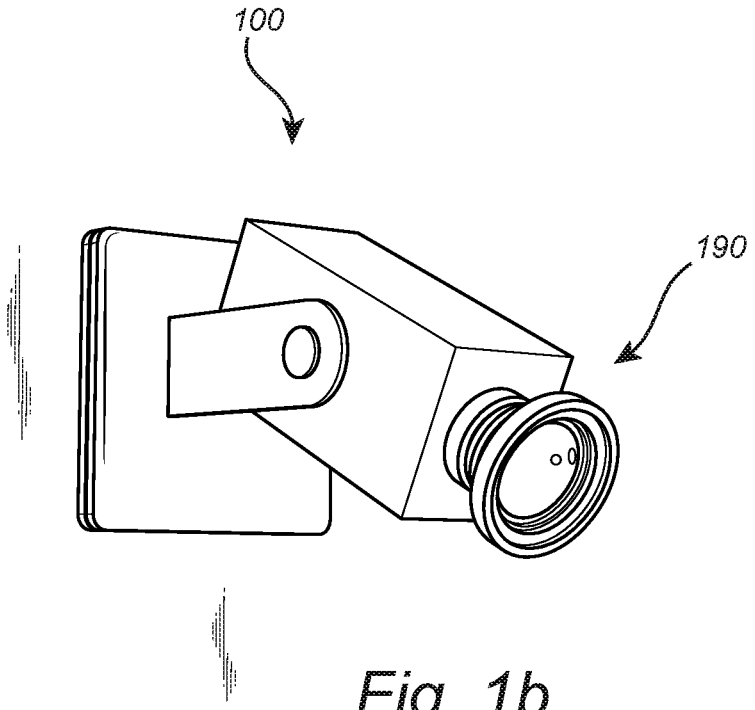

In FIG. 1*a* an exploded perspective view of the different elements of the support arrangement are illustrated in order to more clearly illustrate the technic aspects of the support arrangement.

In FIG. 1*a* a unit in embodied as an electronic shelf label 10, also referred to as ESL, is illustrated. The ESL comprises a casing 11 and a display area 12 that is intended to display the desired information such as for example price, ingredients, origin etc. The casing is substantially rectangular with an upper 13 and lower side 14 arranged parallel to each other, two side surfaces 15, and a forward 16 and rear side 17. In FIG. 1*a* the rear part of the casing 11 is illustrated exploded from the rest of the casing, but this is only to be able to illustrate essential features of the rear side more clearly. The forward side 16 is substantially flat and comprises the display area 18. The casing is for example made of a plastic material that provides the desired structural strength as well as the desired appearance of the ESL 10.

In the forward side of the ESL, means 19 for communication between the ESL and a central control system is arranged. In the illustrated ESL, this communication involves means for infra-red optical communication with an in the store centrally arranged control unit. Other alternatives for communication between the ESL and the central control system are however possible and the means for communication arranged in the ESL are then modified or adapted to the desired system for communication. In a further embodiment of an ESL, the means for communication could be arranged in the side surfaces or integrated within the casing as long as the desired contact between the ESL and the central control unit is achieved. If the support arrangement is used for a camera, all of these features are arranged within the camera housing to ensure the desired communication between the camera and the central control system.

Figure 4A:
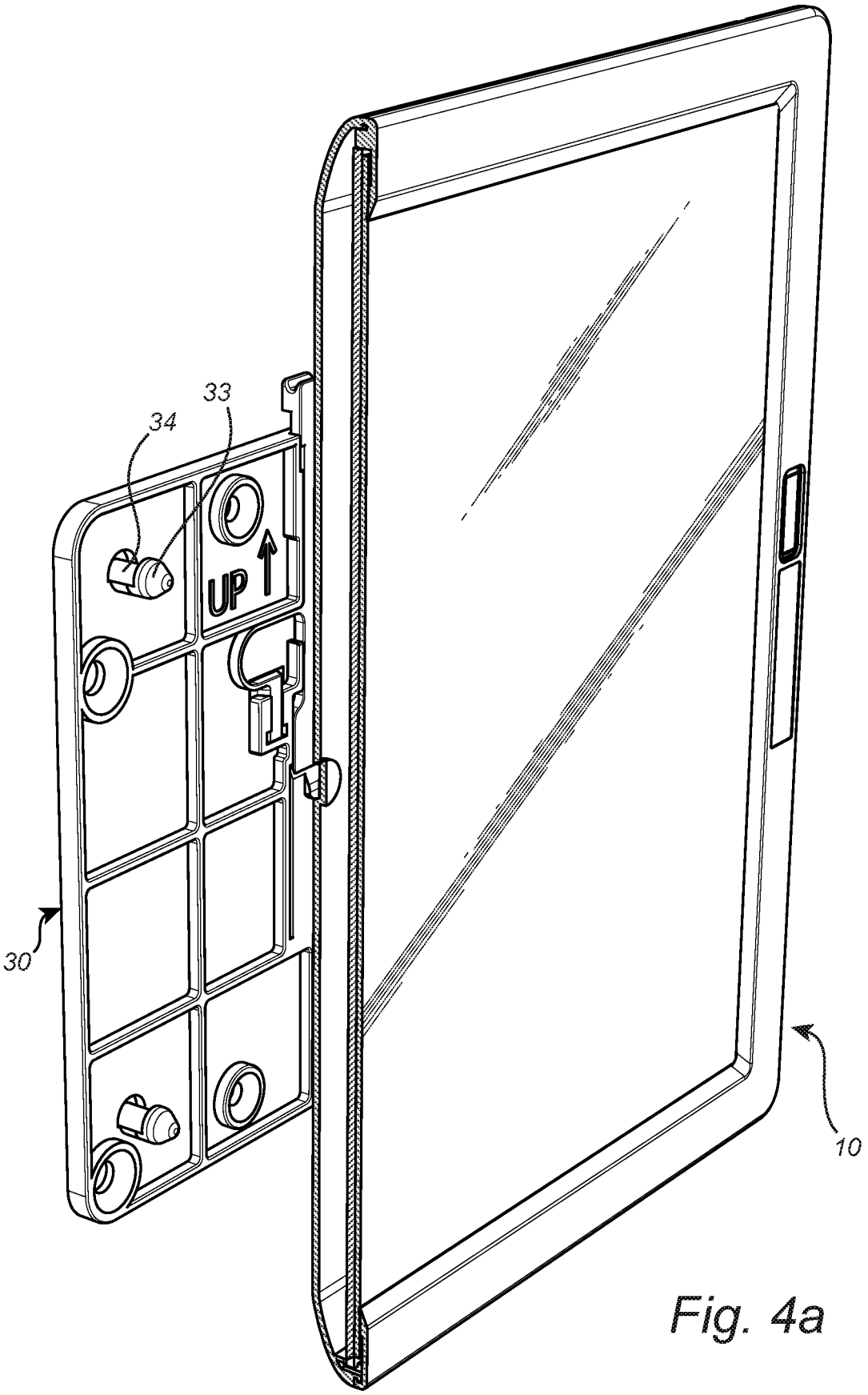
FIGS. 4*a* to 4*d* illustrates different view of the arrangement before and after an electronic shelf label is fitted to the support device.
Figure 4B:
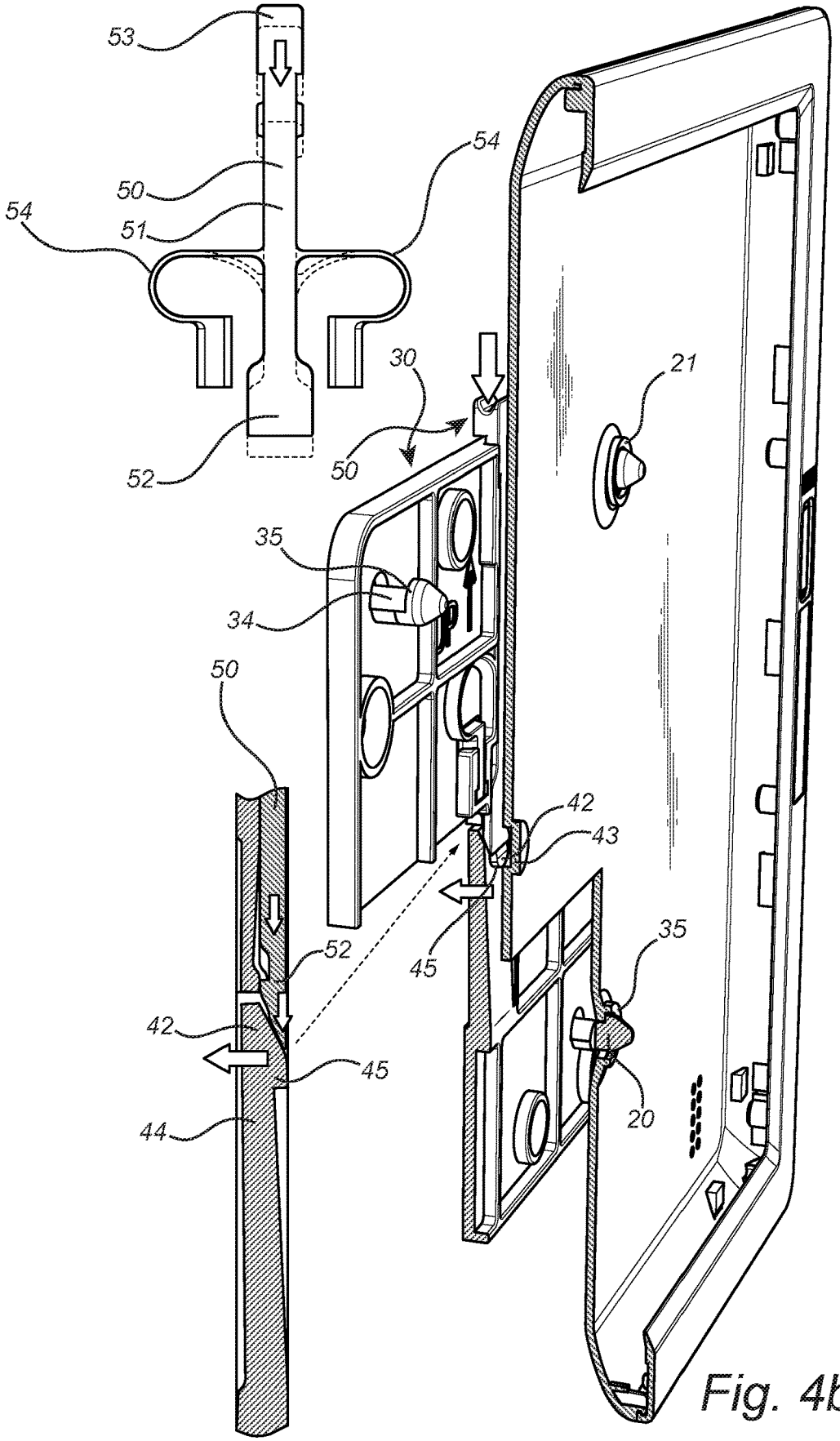
Figure 4C:
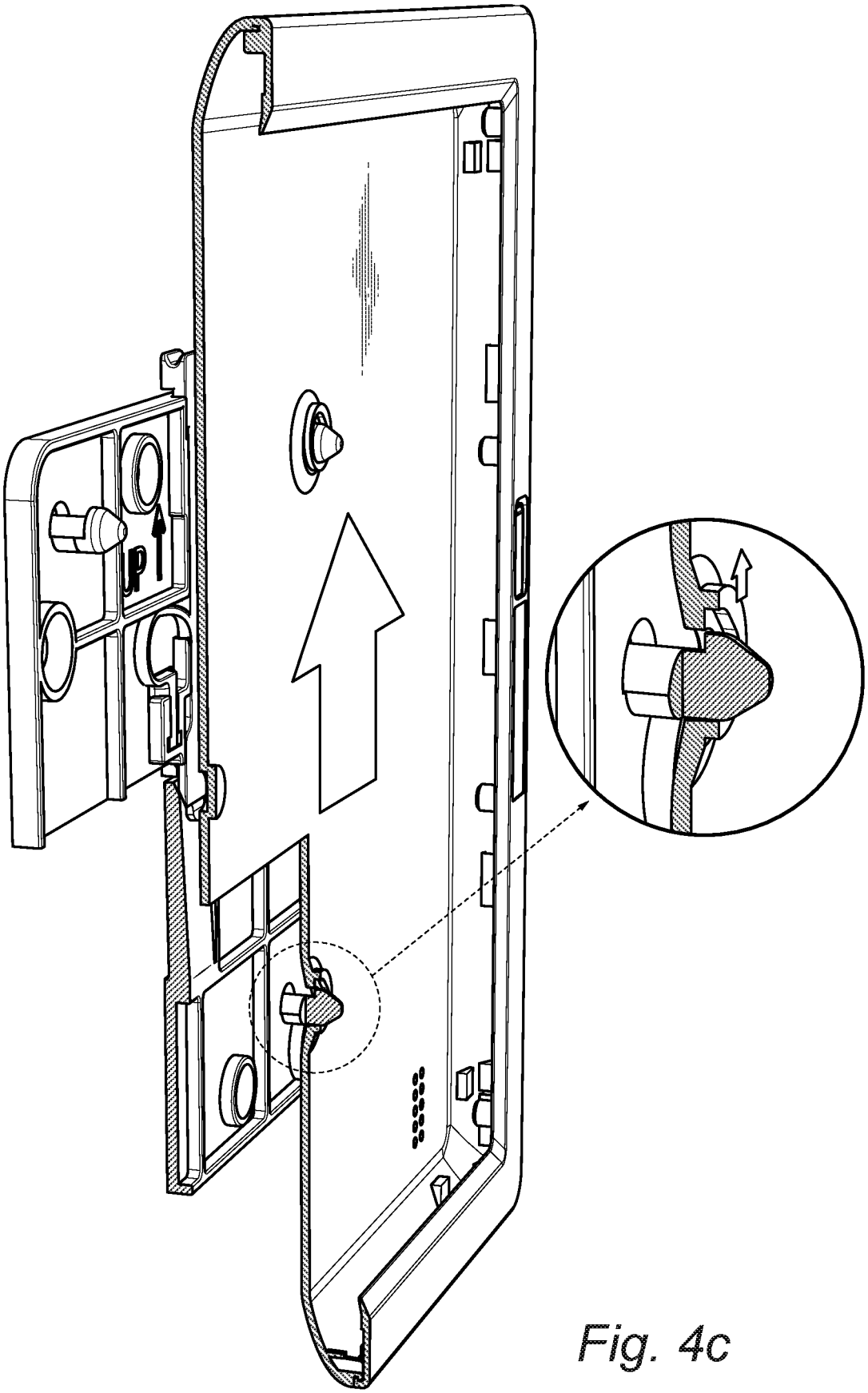
Figure 4D:
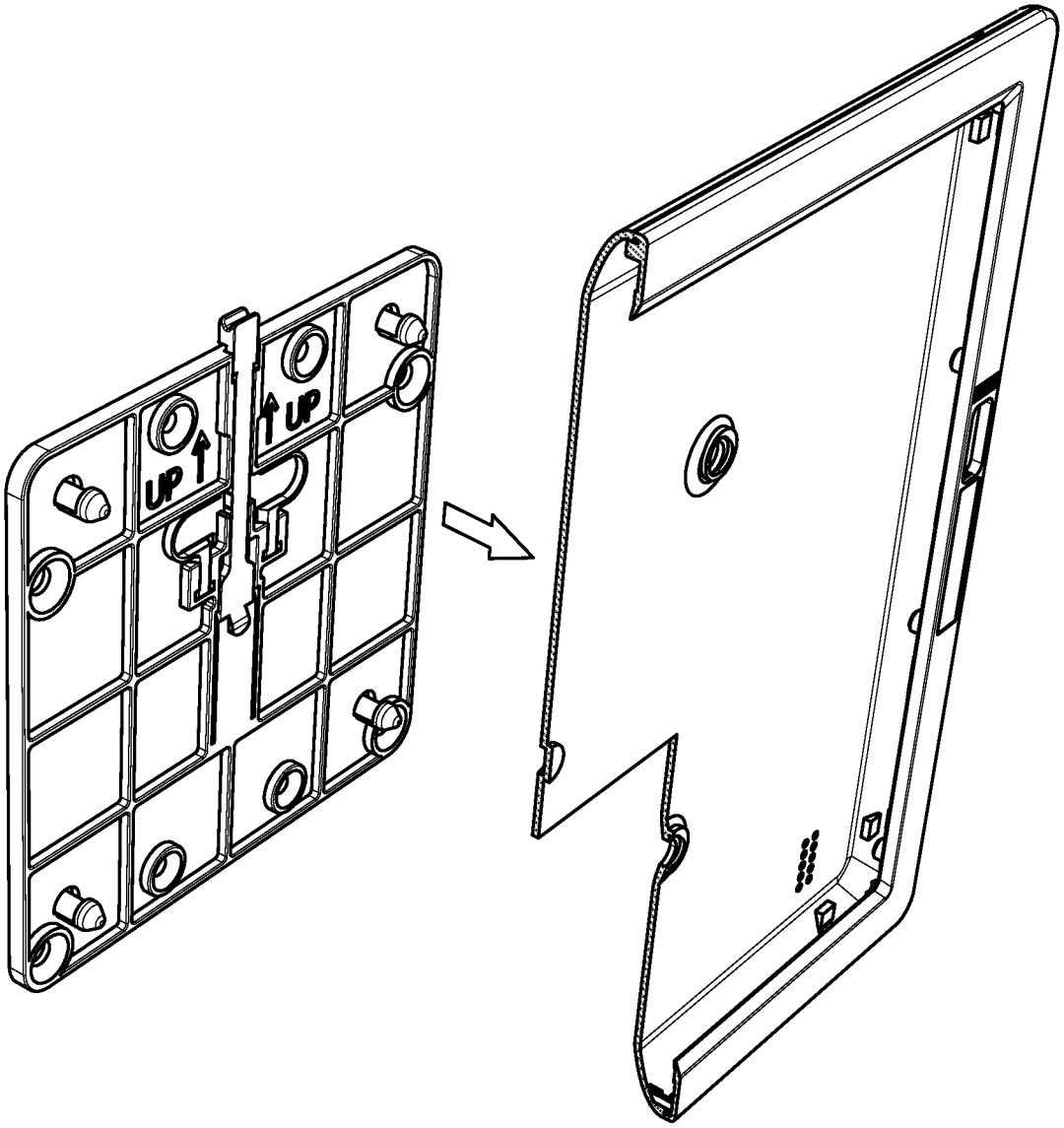

The rear side of the ESL casing is rectangular and substantially flat. In the central area of the rear side, four holes 20 are formed. The holes could also be embodied as recesses formed in the rear side. The holes 20 are arranged in a predetermined pattern, i.e. in the illustrated embodiment the holes form the pattern of a square with the holes in the corners of the square. Different number of holes or recesses as well as patterns could be used like for example further holes arranged in a circle etc. The holes 20 are substantially circular and with the same radius. The inside surface of the rear part of the casing is formed such that the area surrounding each hole, or recess, is shaped such that a shoulder 21 extending around the hole, or recess, is formed. The shoulder is illustrated in FIGS. 4*b* and 4*c* and is intended to co-operate with the support device to attach the ESL to the support device.

The shoulder 21 either extend around the entire hole 20, or recess, as illustrated in the figures, alternatively around a section of the hole, or recess. If the shoulder extend around a section of the hole, or recess, this section should be on the side of the opening that is facing upwards when the ESL is fitted in the intended position to the support device. The shoulder preferably also extend along a section between 90° to 150° around the hole, or recess, such that the ESL could be turned 90 and fitted in either a vertical or horizontal direction.

Figure 2A:
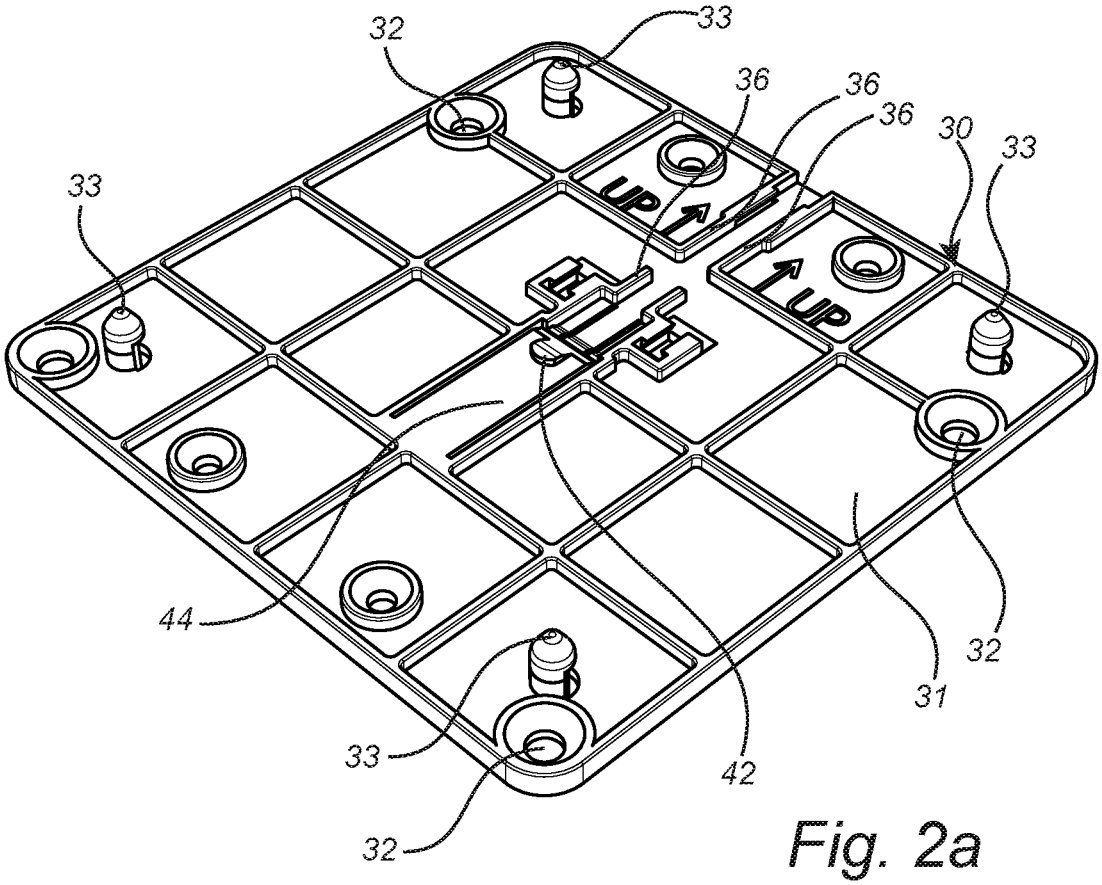
FIG. 2*a* illustrates a perspective views of the support device.
Figure 2B:
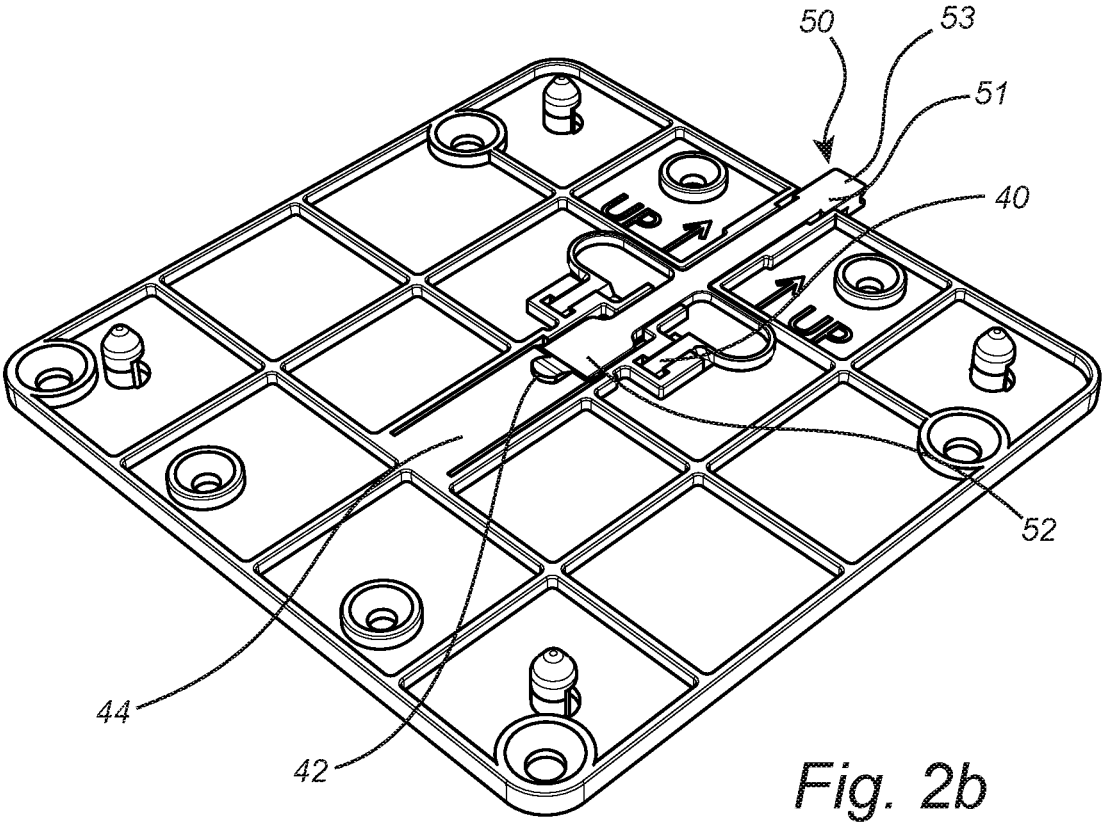
FIG. 2*b* illustrates perspective views of the support device and the release element fitted in the support device.
Figure 3:
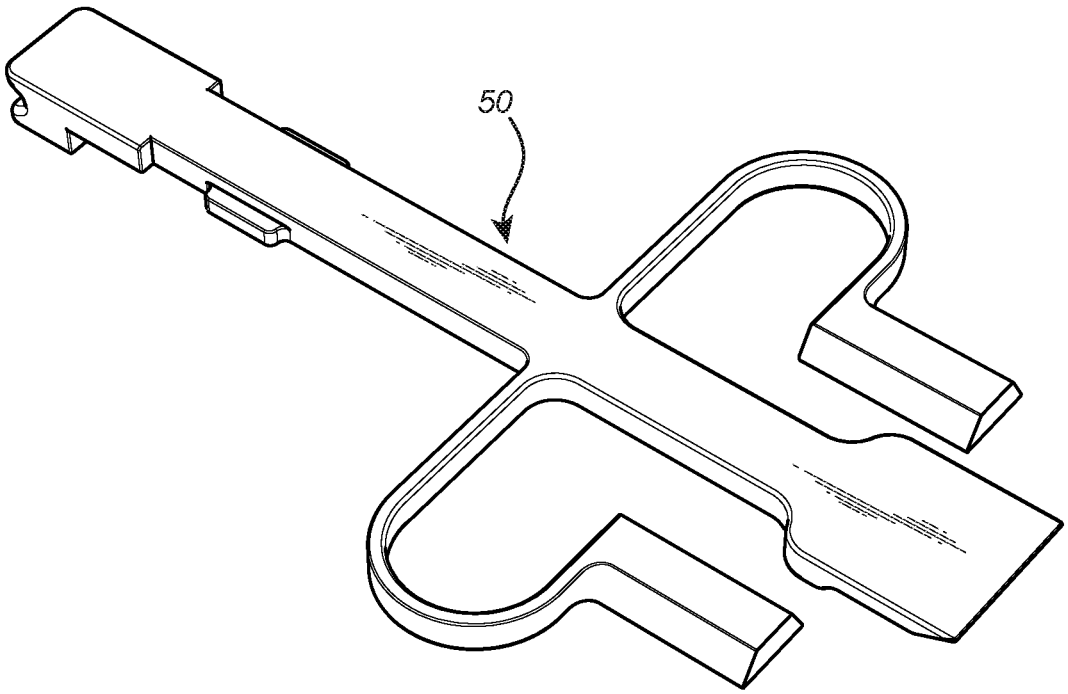
FIG. 3 illustrates a perspective view of the release element.

The support device 30 comprises a substantially flat support body 31 intended to be secured to a wall, a shelf or a support structure arranged at the desired location of the ESL in the store. The support body, illustrated in detail in FIGS. 2*a* and 2*b*, comprises a number of fastening openings 32 to make it possible to secure the support device by screws or snap-fittings to the wall, shelf or support structure. The support device could also be fastened by adhesive to eliminate any damage to the wall, shelf or support structure. The support device furthermore comprises a corresponding number of attachment protrusions 33 as the number of recesses in the rear side of the ESL, i.e. in the illustrated embodiment four attachment protrusions 33. The attachment protrusions extend substantially transverse from the support body and are arranged in a corresponding pattern on the support body as the holes 20, or recesses, in the rear side of the ESL, i.e. in a square. The attachment protrusions have a shape and dimensions corresponding to the shape and dimensions of the holes, or recesses, in the rear side of the ESL to make it possible to fit the attachment protrusions in the holes, or recesses.

In the illustrated embodiment of the support arrangement, the holes 20 in the rear side of the ESL 10 have a substantially circular shape and the attachment protrusions 33 a corresponding circular cross-section. The attachment protrusions extend substantially straight from the support body and have a constant radius before each protrusion is ended by a rounded outer end. The extension of the attachment protrusions must correspond to the space inside the holes, or recesses, to ensure that the attachment protrusions fit in the space. Each attachment protrusion 33 comprises a cut-out portion formed in the side of the attachment protrusion that is intended to face upwards when the support device 30 is fastened in the intended position on the wall, shelf or support structure such that a support surface is formed in the area of the cut-out portion. The support surface could be embodied in different ways and in the illustrated embodiment each attachment protrusion comprises a first surface 34 arranged substantially transverse to the plane of the support body and a second surface 35 extending from the outer end of the first surface substantially parallel to the plane of the support body upwards when the support device is arranged in the intended position. The second surface 35 of the support surface is intended to bear against the shoulder 21 extending around the hole 20, or recess, in the rear side of the ESL 10 to maintain the electronic shelf label 10 attached to the support device 30. In the illustrated embodiment the first surface 34 will be in contact with the peripheral surface surrounding the hole 20 and the second surface 35 will bear against the shoulder to maintain the ESL attached to the support device.

The support arrangement according to the invention furthermore comprises a releasable locking device 40 arranged to maintain the support surfaces of the support device in contact with the shoulders 21 surrounding the holes 20, or recesses. The locking device 40 has a male/female configuration and in the illustrated embodiment of the support arrangement the female part 41 is arranged in the rear side of the ESL 10 and the male part 42 in the support device 30.

In the illustrated embodiment the female part is a substantially circular recess 43 arranged in the center of the square formed by the holes in the rear side of the ESL, illustrated in FIGS. 4*b* and 4*c*. The male part 42 is a resilient protrusion extending from the support body. The resilient protrusion is shaped like an elongated member 44 extending from the support body 31 towards the ESL 10. The elongated member 44 has a nob 45 in the outer end with a dimension corresponding to the radius of the circular recess 43 such that the nob in the outer end fit within the recess and locks the ESL to the support device. The resilient protrusion is forced towards the rear side of the ESL 10 and as soon as the ESL is in the correct position in relation to the support device the nob 45 snaps into the recess to lock the ESL to the support device.

The locking device 40 is released by a release element 50 arranged to release the connection between the male 42 and female 43 element, i.e. the circular recess 43 and the nob 45 in the outer end of the elongated member 44. The release element 50 comprises an actuator 51 extending substantially parallel to the flat support body 31 from the elongated member 44 outside the periphery of the support body 31 in the plane of the support body.

The elongated actuator 51 has a forward end 52 arranged adjacent to the male element 42 and a second end arranged in the opposite end of the actuator. The length of the actuator is selected such that the second end is hidden behind the ESL 10 but accessible via the space formed behind the ESL between the ESL and the wall, shelf or support structure. The actuator 51 is movable along the axis defined by the extension of the elongated actuator between a first position in which the electronic shelf label is attached to the support device and a second position in which the electronic shelf label is released from the support device. The release element is movably attached to the support body 31 that have guiding rails 36 arranged on both sides of the elongated actuator to maintain and guide the actuator during movement between the first and second position. The release element 50 furthermore comprises two springs 54 arranged to return the elongated actuator 51 to the first position when no force is acting on the second end of the actuator forcing it to the second position to ensure that the ESL is locked to the support device until there is a desire to remove it.

The different positions of the ESL 10, the support device 30 and the release element 50 are illustrated in FIGS. 4*a* to 4*d* to more clearly illustrate the function of the arrangement. In the first position, the release element is located separated from the resilient member 44 and the nob is forced into the circular recess 43. When the actuator 51 is moved towards the second position, the forward end 52 of the actuator 51 is sliding towards the elongated member 44 and forces the resilient elongated member 44 towards the support body and away from the ESL such that the nob is removed from the circular recess 43. Once the nob is fully removed from the circular recess the ESL 10 is moved slightly upwards to disconnect the second surface of the attachment protrusion from the shoulder 21 surrounding the holes 20 in the rear side of the ESL 10 and the ESL 10 is released from the support device 30.

The different embodiments described above could all be combined and modified in different ways without departing from the scope of the invention that is defined by the appended claims.

The invention claimed is:

1. Support arrangement for a unit used within a retail environment, said arrangement comprising:

a unit comprising a casing with a substantially flat rear side, at least three recesses arranged in a predetermined pattern are formed in the rear side of the unit, said recesses are shaped such that a shoulder extending around at least a section of the recess in the rear side is formed;

a support device comprising a substantially flat support body intended to be secured to a wall, a shelf or a support structure, said support device comprises a corresponding number of attachment protrusions as the number of recesses, said attachment protrusions have shape and dimension corresponding to shape and dimension of the recesses and each comprising a support surface intended to bear against the shoulder of the recesses to maintain the unit attached to the support device; and a releasable locking device arranged to maintain the support surfaces in contact with the shoulders in the recesses, said locking device has a male/female configuration and comprises a male element, a female element and a release element arranged to release the connection between the male and female element to release the unit from the support device, wherein the male element and female element are arranged between the rear side of the unit and the flat support body, and the release element comprises an actuator extending substantially parallel to the flat support body outside the support body in the plane of the support body.

2. Support arrangement according to claim 1, wherein the at least three recesses and corresponding attachment protrusions are arranged in a pattern that makes it possible to secure the unit to the support device in both a first and a second position, said first and second position are located 90° from each other.

3. Support arrangement according to claim 1, wherein the support body has a substantially rectangular, circular or oval shape with smaller extension than the unit in the plane of the rear side.

4. Support arrangement according claim 1, wherein the number of recesses and attachment protrusions are at least four and arranged in the pattern of a square.

5. Support arrangement according to claim 1, wherein the female element of the coupling device is a recess formed in the rear side of the unit and the male element is a resilient protrusion arranged in the support body.

6. Support arrangement according to claim 5, wherein the release element is movable between a first position in which the unit is attached to the support device and a second position in which the unit is released from the support device.

7. Support arrangement according to claim 6, wherein the release element in the second position is arranged to force the resilient male element into a non-engagement position with the female element.

8. Support arrangement according to claim 7, wherein the release element is resiliently arranged in the support device such that it is returned to the first position if no force is acting on the release element.

9. Support arrangement according to claim 1, wherein the unit is an electronic shelf label or a camera.

* * * * *